United States Patent [19]

Kikuchi et al.

[11] Patent Number: 4,930,915

[45] Date of Patent: Jun. 5, 1990

[54] PRINTER HAVING MEANS FOR IDENTIFYING PRINT HEAD TYPE

[75] Inventors: Hiroshi Kikuchi; Jiro Tanuma; Hideaki Ishimizu; Tadashi Kasai, all of Tokyo, Japan

[73] Assignee: Oki Electric Industry Co., Ltd., Tokyo, Japan

[21] Appl. No.: 141,221

[22] Filed: Jan. 6, 1988

[30] Foreign Application Priority Data

Jan. 7, 1987 [JP] Japan ..... 62-541

[51] Int. Cl.[5] ..... B41J 3/12

[52] U.S. Cl. ..... 400/175; 400/692

[58] Field of Search ..... 400/121, 124, 174, 175, 400/692

[56] References Cited

U.S. PATENT DOCUMENTS

| | | | |
|---|---|---|---|
| 4,159,541 | 6/1979 | Ward | 365/63 X |
| 4,388,010 | 6/1983 | Mott | 400/692 |
| 4,741,634 | 5/1988 | Mozaki | 400/175 X |
| 4,778,291 | 10/1988 | Mitsuhashi | 400/175 X |

FOREIGN PATENT DOCUMENTS

| | | | |
|---|---|---|---|
| 3233425 | 4/1984 | Fed. Rep. of Germany | 400/175 |
| 190873 | 10/1984 | Japan | 400/175 |
| 60-24983 | 7/1985 | Japan | 400/175 |

*Primary Examiner*—Paul T. Sewell

*Attorney, Agent, or Firm*—Wenderoth, Lind & Ponack

[57] ABSTRACT

A printer includes identification circuitry disposed in a print head for identifying the type of the print head loaded on a carriage portion for printing characters on a print paper, and head connectors disposed on the carriage portion for enabling a plurality of different types of print heads to be commonly connected with a drive circuit and a control portion. The control portion is operative to identify the type of the loaded print head on the basis of the content of the identification circuitry, and also to perform controlling of the drive circuit under certain controlling conditions corresponding to the type of thus identified print head.

4 Claims, 6 Drawing Sheets

PRINTER HAVING MEANS FOR IDENTIFYING PRINT HEAD TYPE

BACKGROUND OF THE INVENTION

1. Field of the Invention

The present invention relates to printers such as serial printers, and more particularly to the control of such printers.

2. Description of the Related Art

Known serial printers include a print head for printing characters on a print form or paper, a carriage portion for loading thereon the print head, a space motor for moving the carriage portion, a line feed motor for feeding the print form, and a control unit for controlling operation of the aforesaid component parts. The control unit is connected to the space motor, the line feed motor and the print head via connecting cords. A typical example of such known serial printers will be described below with reference to the accompanying drawings.

FIG. 6 shows the general construction of the conventional serial printer which includes a control unit 1 and a carriage portion 2 connected together via a connecting cord 3. The control unit 1 has a control portion 4 and a drive circuit 5. The control portion 4 is composed of a microprocessor, for example, and serves to control a space motor and a line feed motor (neither shown) as well as the drive circuit 5. The carriage portion 2 includes a print head 8 and a cooperating pair of head connectors 6, 7 for connection of the print head 8, and is movable upon rotation of the space motor. The head connector 6 is disposed on a support plate (not shown) of the carriage portion 2 and is connected with the connecting cord 3. The head connector 7 is provided on the print head 8 and adapted to be coupled with the head connector 6 for connecting the input side of the print head 8 through the connecting cord 3 to the output side of the drive circuit 5.

FIG. 7 shows a schematic circuit diagram of a conventional matrix printer used for driving a print head **8*a* consisting of 24 pins or wires. In this figure, those component parts designated by reference characters 3*a*–8*a* correspond respectively to the component parts 3–8 shown in FIG. 6 and the suffix "a" indicates that the respective component parts are so constructed as to meet the various requirements for driving the print heads 8*a* consisting of 24 pins. The print head 8*a* includes a total of 24 driving coils (electromagnets) 801–824 each for selectively driving a corresponding one of the 24 pins arranged in two columns of 12 pins which correspond in position to two rows of 12 dots to be mutually printed. The control portion 4*a* delivers to the drive circuit 5*a*, two timing signals $T_1$, $T_2$ for determining the timing of the application of driving power to the respective columns of 12 pins, and drive signals $D_1$–$D_{24}$ for driving the respective pins. The drive circuit 5*a* includes two PNP transistors 91, 92 having emitters connected with the power supply and adapted to be turned on and off by the timing signals $T_1$, $T_2$, and a total of 24 NPN transistors 101–124 having emitters connected to the ground and adapted to be turned on and off by the drive signals $D_1$–$D_{24}$. Collectors of the transistors 91, 92 are connected successively through the connecting cord 3*a* and the head connectors 6*a*, 7*a* with one end of the drive coils 801–812 and one end of the drive coils 813–824, respectively. Collectors of the transistors 101–124 are connected successively through the connecting cord 3*a* and the head connectors 6*a*, 7*a* with the other end of the drive coils 801–824, respectively. Thus, each of the head connectors 6*a*, 7*a*** has at least 26 pins or terminals.

Operation of the printer thus constructed is described below.

When the level of timing signals $T_1$, $T_2$ delivered from the control portion **4*a* is low (L), the transistors 91, 92 are turned on whereupon a drive voltage is supplied from the drive power supply to one end of the drive coils 801–812 and also to one end of the drive coils 813–824. When drive signals $D_1$–$D_{24}$ delivered from the control portion 4*a* are high (H), the transistors 101–124 are turned on, whereupon the other end of the drive coils 801–824 becomes low (L). Consequently, an electric current flows through those drive coils to which the drive voltage is applied, thereby driving corresponding pins of the print head 8*a*. Thus, the 24 pins of the print head 8*a*** are selectively driven depending on the level (H/L) of the timing signals $T_1$, $T_2$ and the drive signals $D_1$–$D_{24}$.

FIG. 8 shows a schematic circuit diagram of another conventional printer used for driving a print head **8*b* consisting of 9 pins. In this figure, those component parts designated by reference characters 3*b*–8*b* correspond respectively to the component parts 3–8 shown in FIG. 6 and the suffix "b" indicates that the respective component parts are so constructed to satisfy the requirements for driving the print head 8*b* consisting of 9 pins. The print head 8*b* includes a total of 9 drive coils 801–809 each for selectively driving a corresponding one of the 9 pins corresponding in position to a column or row of 9 dots to be mutually printed. The control portion 4*b* delivers to the drive circuit 5*b* a timing signal $T_1$, and a total of 9 NPN transistors 101–109 having emitters connected to the ground and adapted to be turned on and off in response to the drive signals $D_1$–$D_9$. The collector of the transistor 91 is connected through the connector cord 3*b* and the head connectors 6*b*, 7*b* with one end of the drive coils 801–809, the other end of the drive coils 801–809 being connected in common with collectors of the respective transistors 101–109**.

The printer of the foregoing construction operates as described below.

When a timing signal $T_1$ delivered from the control portion **4*b* is low (L), the transistor 91 is turned on whereupon the drive power supply applies a drive voltage to one end of the drive coils 801–809. In this instance, if drive signal $D_1$–$D_9$ are high (H), the transistors 101–109 turn on, thereby enabling an electric current to flow through the corresponding drive coils 801–809. Thus, the 9 pins of the print head 8*b*** are selectively driven in dependence on the level (H/L) of the timing signal $T_1$ and the drive signals $D_1$–$D_9$.

The conventional printers described above are not fully satisfactory because of the following reasons.

The printer incorporating the 24-pin print head **8*a* shown in FIG. 7 is advantageous in that the print quality is high because the diameter of each individual pins is small and the printed character is composed of a large number of dots. On the other hand, the printer of this type has drawbacks in that the print head 8*a*** is heavy and hence gives an increased load on the space motor for driving the carriage portion. With this increased load, the printer is not suitable for a high speed printing operation and consumes a considerable amount of electric power.

Conversely, the printer having the 9-pin print head 8b shown in FIG. 8 is disadvantageous in that due to a large diameter of each individual pin and a small number of dots constituting the character, the print quality is low. The printer of this type is, however, lightweight and hence is suitable for a high speed printing operation and consumes only a small amount of electric power.

Since a high speed and high quality printing can be obtained only by an expensive and large-sized printer, it has been customary practice to select for use the 24-pin print head printer and the 9-pin print head printer in view of the desired purposes, and in consideration of the advantages of the respective printers. Such a conventional practice is however tedious and time-consuming and requires two printers which are costly to maintain.

SUMMARY OF THE INVENTION

With the foregoing difficulties in view, it is an object of the present invention to provide a printer which is compact in size and inexpensive to maintain but is capable of loading various types of print heads, thereby providing an optimum printing for attaining the desired purposes.

According to the present invention, a printer includes identification means disposed on a print head for identifying the type of the print head now loaded on a carriage portion for printing characters on a print paper, connector means disposed on the carriage portion for enabling a plurality of different types of print heads to be connected commonly with a driver circuit and a control portion. The control portion is operative to identify the type of the loaded print head on the basis of the content of the identification means, and also to perform controlling operations of the drive circuit under certain controlling corresponding to the type of thus identified print head.

With the printer thus constructed, the control portion functions to identify the type of the print head connected with the connector means such as connector heads on the basis of the content of the identification means, and also to control the driver circuit under certain controlling conditions corresponding to the thus identified type of the print head. It is also possible to control the print speed using a space motor and the paper feed using a line feed motor in conformity with the type of the loaded print head. Accordingly, even with only one printer used, it is possible to replace the existing print head with another head of an optimum type in view of the desired printing purposes. According to the invention, it is no longer necessary to selectively use various printers or to use an expensive and large-sized printer for meeting the user's desire. The printer of the present invention is compact in size and inexpensive to manufacture and maintain. Because of the easiness of print-head replacement, the printer of the invention is applicable to various types of printing at the user's desire.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 3 (*b*) is a schematic circuit diagram of the printer incorporating a print head consisting of 9 pins;

FIG. 5(*b*) is a schematic circuit diagram of a printer incorporating the print head shown in FIG. 5(*a*);

DETAILED DESCRIPTION OF THE PREFERRED EMBODIMENT

Figure 1:
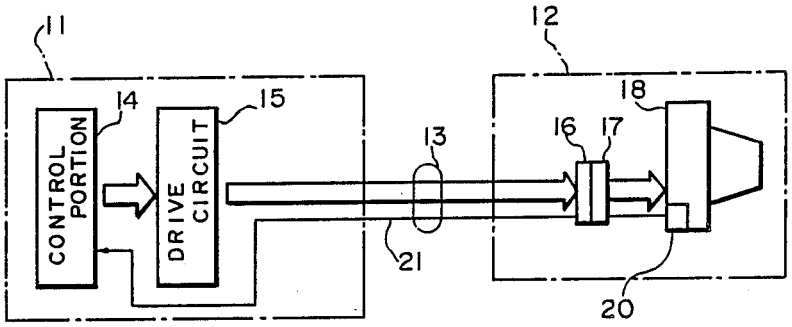
FIG. 1 is a schematic view showing the general construction of a printer embodying the present invention.
Figure 6:
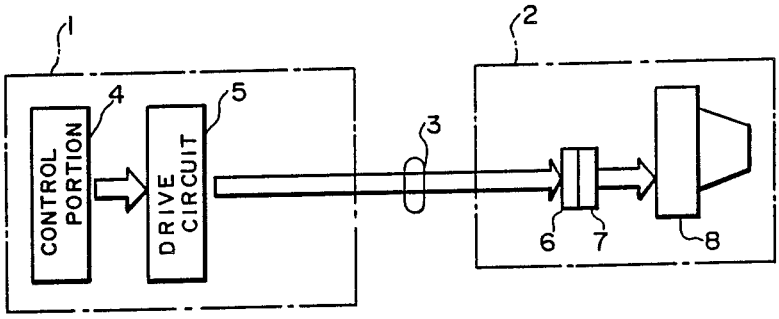
FIG. 6 (PRIOR ART)
FIG. 6 is a schematic view showing the general construction of a conventional printer.

FIG. 1 shows the general construction of a printer embodying the present invention. In this figure, those component parts designated by reference numerals 11–18 correspond respectively to the component parts 1–8 shown in and described above with reference to FIG. 6. The print head 18 includes an identification means 20 for identifying the type of a print head loaded or used in the printer. The identification signal representing the type of the loaded print head 18 is transmitted to the control portion 14 through a signal path or line 21 in the connecting cord 13. The control portion 14 is so constructed as to identify the type of the print head 18 loaded by virtue of the coupling engagement of the head connector 17 with the head connector 16, on the basis of the identification signal delivered from the identification means 20, and also to control the print head 18, a space motor and a line feed motor (neither shown) under certain controlling conditions suitable for the identified print head. Stated more specifically, the control portion 14 serves to control operation of the print head 18 under a suitable condition to meet various driving conditions or requirements such as the number of print dots, print timing, drive period, drive waveshape, voltage, current and temperature. The space motor and the line feed motors are controlled by the control portion 14 to realize a print speed and a paper feed which are suitable for the identified print head.

A first embodiment of the present invention will be described in greater detail with reference to FIGS. 2, 3(*a*) and 3(*b*).

Figure 2:
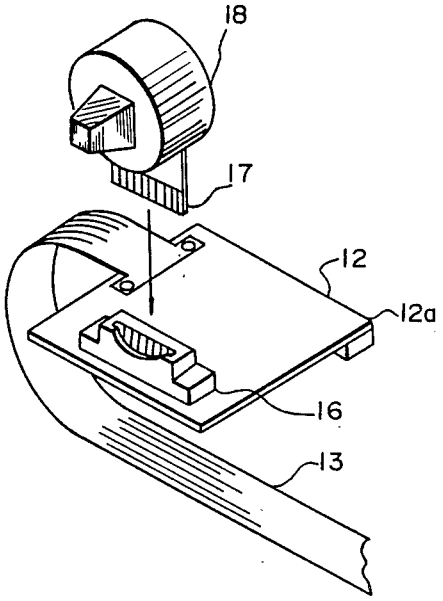
FIG. 2 is a perspective view of a carriage portion of the printer shown in FIG. 1.

FIG. 2 is a perspective view of the carriage portion 12. The print head 18 includes a head connector 17 in the shape of a rectangular plate or board projecting from the outer periphery of the head body. The head connector 17 is adapted to be fitted in a mating head connector 16 disposed on a support plate 12*a* of the carriage portion 12 for supporting the head connector 17. The support plate 12*a* has a circuit pattern or a wiring by means of which the head connector 16 is connected in circuit with one end (mounting portion) of the connector cord 13 secured to the support plate 12*a*, thereby enabling signal reciprocation with respect to the drive circuit 15 and the control portion 14. The head connectors 16, 17 have a common configuration and pin arrangement for enabling connection of a plurality of different types of print heads. The connecting cord 13 is composed of a flexible printed board or a flat cable, thus enabling smooth movement of the carriage portion 12.

Figure 3:
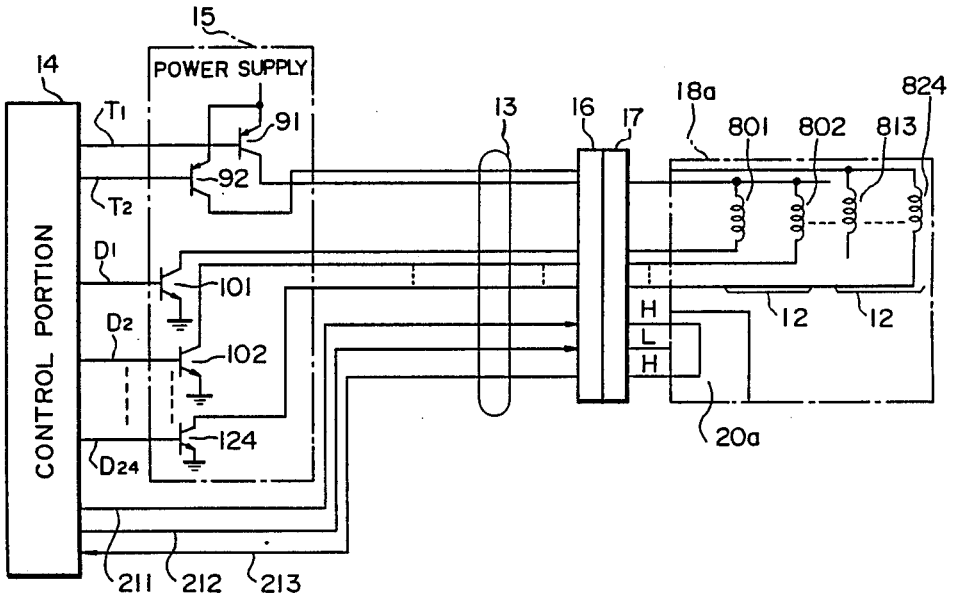
FIG. 3 (*a*) is a schematic circuit diagram of the printer incorporating a print head consisting of 24 pins.
Figure 3:
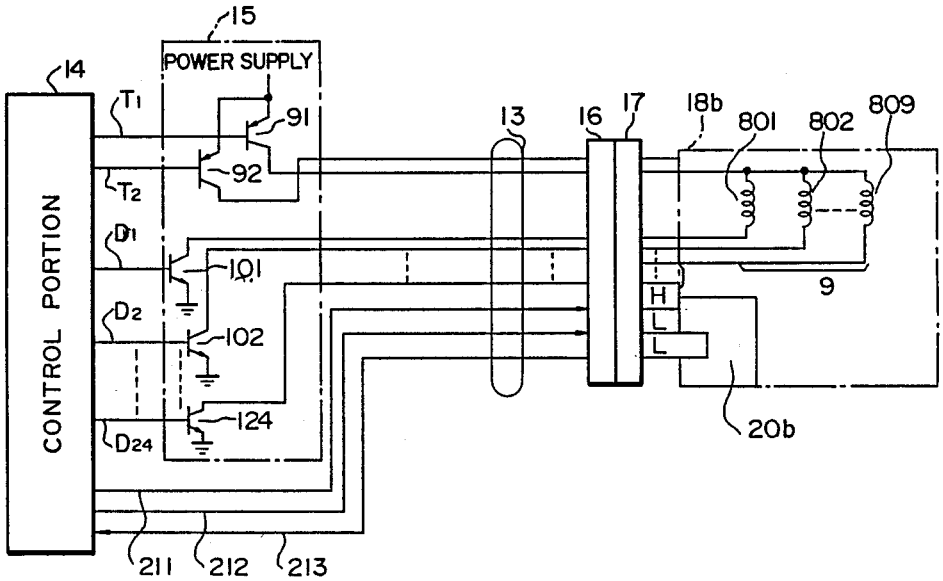
Figure 7:
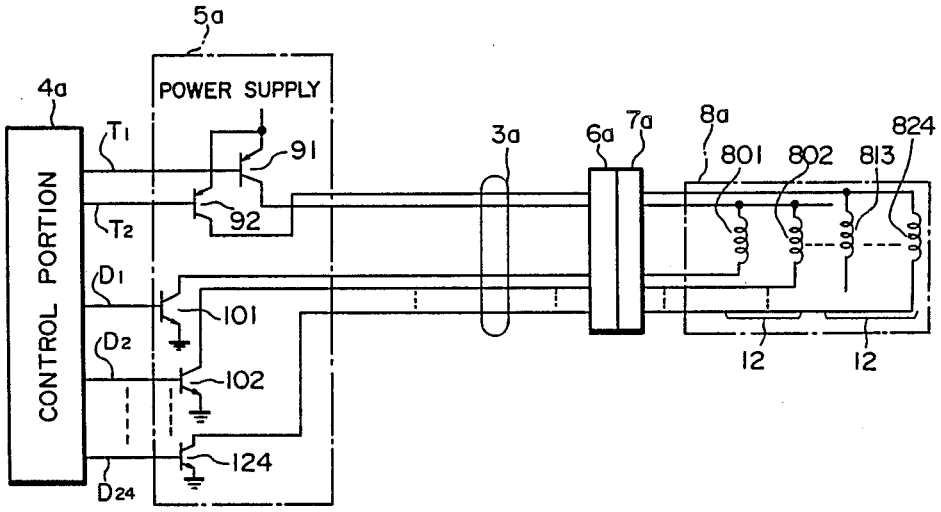
FIG. 7 (PRIOR ART)
FIG. 7 is a schematic circuit diagram of a conventional printer having a print head consisting of 24 pins.

FIGS. 3(*a*) and 3(*b*) are schematic circuit diagrams of the printer according to the first embodiment, illustrative of the manner in which two different types of print heads are commonly driven by a single circuit. The print head 18*a* shown in FIG. 3(*a*) consists of 24 pins and is loaded on the carriage portion 12 by virtue of the coupling engagement between the head connectors 16, 17. On the other hand, the pin head 18*b* shown in FIG. 3(*b*) has 9 pins and is loaded on the carriage portion 12 by virtue of the coupling engagement of the head connector 17 with the head connector 16. In this embodiment, the signal line 21 shown in FIG. 1 is composed of three signal lines 211–213 extending between the control portion 14 and the head connector 16. The control portion 14 delivers a high level signal (H) and a low level signal (L) respectively through the signal lines 211, 212 to the head connector 16 and receives from the head connector 16 a identification signal through the signal line 213. The control portion 14 selectively supplies timing signal $T_1$, $T_2$ and driving signals $D_1$–$D_{24}$ to the drive circuit 15 on the basis of the identification signal. The drive circuit 15 is the same in construction as the driver circuit 5*a* shown in and described with reference to FIG. 7. The output side of the drive circuit 15 is connected with the head connector 16. The 24-pin print head 18*a* is functionally the same as the print head 8*a* shown in FIG. 7 and includes an identification means 20*a* (FIG. 3(*a*)) for short-circuiting the signal lines 211 and 213 when the head connector 17 is coupled with the head connector 16. Consequently, the identification means 20*a* delivers a high level signal (H), as an identification signal, through the signal line 213 to the control portion 14.

Figure 8:
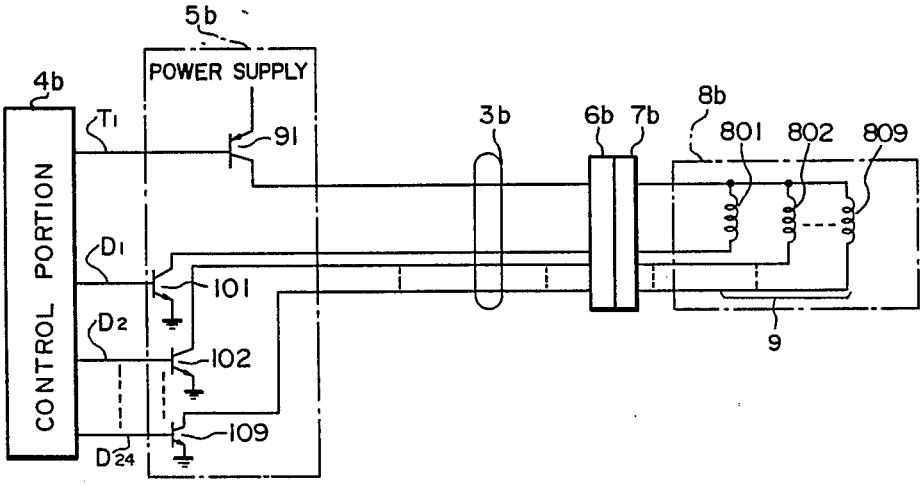
FIG. 8 (PRIOR ART)
FIG. 8 is a schematic circuit diagram of another conventional printer having a print head consisting of 9 pins.

On the other hand, the 9-pin print head 18*b* is functionally the same as the print head 8*b* shown in FIG. 8 and includes an identification means 20*b* (FIG. 3(*b*)) for short-circuiting the signal lines 212 and 213 when the head connector 17 is coupled with the head connector 16. Thus, the identification means 20*b* delivers a low level signal (L), as an identification signal, through the signal line 213 to the control portion 14. With this arrangement, the head connector 16 has at least 29 pins. The head connector 17 has the corresponding number of pins but when used with the print head 18*a*, it includes an empty or non-connected pin which corresponds in position to the signal line 212. Likewise, when used with the print head 18*b*, the head connector 17 has a total of 16 non-connected pins corresponding in position to 15 drive coils and the signal line 211.

Figure 4:
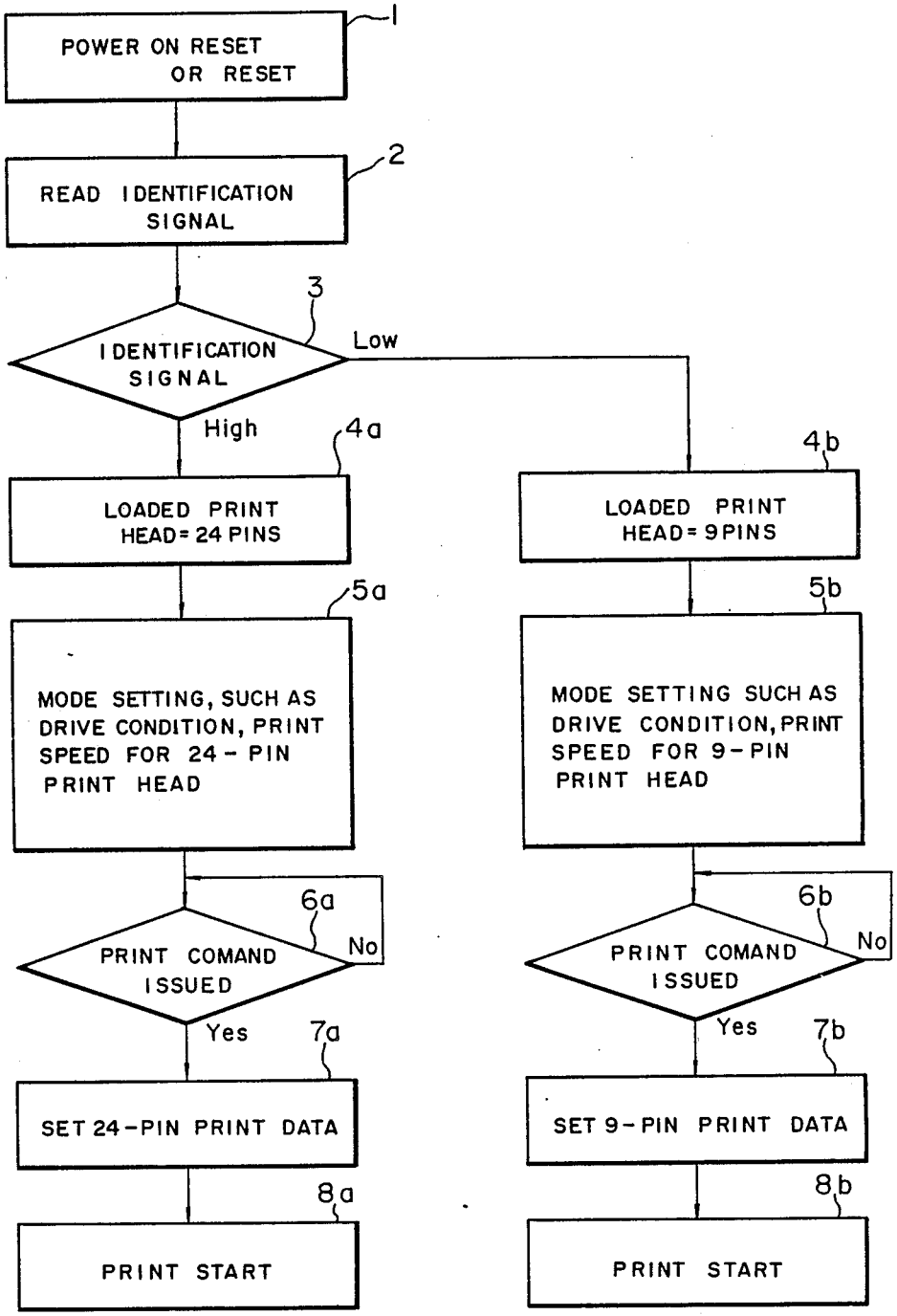
FIG. 4 is a flow chart illustrative of the operation of the printer.

The operation of the printer of the foregoing embodiment will be described below with reference to the flow chart shown in FIG. 4.

For purposes of illustration, the description is first directed to an instance where the 24-pin print head 18*a* is loaded as shown in FIG. 3(*a*).

After the power-on reset or reset process, the control portion 14 reads the state value of the identification signal (appearing on the signal line 213) as being high (H) and thus identifies the loaded print head 18 as being a 24-pin print head 18*a* (Steps 1–3). Then, the control portion 14 proceeds with the setting of the operation modes, such as the driving condition, print speed and paper feed rate which are suitable for the identified 24-pin print head 18*a* (Steps 4*a* and 5*a*). That is, the control portion 14 adjusts an internal timer to set the driving period and the print timing to predetermined values suitable for the 24-pin print head 18*a*, preparatory to issuing of timing signals T1, T2 for driving the driver circuit and drive signals D1–D24 for driving the 24-pin print head 18*a*. At the same time, the control portion 14 also sets the drive mode of the space motor and the line feed motor for moving the drive head 18*a* at a suitable speed while feeding the print paper at a suitable rate.

Thereafter, a print demand signal is issued from an external controller (not shown) whereupon the control unit 14 chooses the print data relating to the 24-pin print head 18*a* stored in an internal memory, and issues timing signals $T_1$, $T_2$ at the desired timing, and driving signals $D_1$–$D_{24}$ corresponding to the print data, thereby selectively driving the 24 pins of the print head 18*a* for printing characters on the print paper (Steps 6*a*–8*a*). The printing operation is performed in the same manner as described in reference to FIG. 7.

Now, the description is directed to another instance where the 9-pin print head 18*b* is loaded on the printer as shown in FIG. 3(*b*).

After the power-on reset or reset process, the control portion 14 reads the state value of the identification signal (appearing on the signal line 213) as being low (L) and thus identifies the loaded print head 18 as being a 9-pin print head 18*b* (Steps 1–3). Then, the control portion 14 proceeds with the setting of the operation modes, such as the driving condition, print speed and paper feed rate which are suitable for the identified 9-pin print head 18*b* (Steps 4*b* and 5*b*). Upon receipt of a print demand signal, the control unit 14 chooses the print data relating to the 9-pin print head 18*b* stored in the internal memory, and starts the printing operation (Steps 6*b*–8*b*). That is, the control portion 14 issues a timing signal $T_1$ at the desired timing and drive signals $D_1$–$D_9$ corresponding to the selected print data, thereby selectively driving the 9 pins of the print head 18*b*. The printing operation is performed in the same manner as described in reference to FIG. 8.

According to the first embodiment described above, two different types of print heads, namely the 24-pin print head 18*a* and the 9-pin print head 18*b* are loaded on the same printer. The present invention is, however, not limited to these two types, but is also applicable to the loading of other various printer heads in view of the desired printing requirements. For example, in addition to the 24-pin print head 18*a* stated above, a print head with 18 pins arranged in zig-zag formation and a print head consisting of 36 pins are also available for a high speed printing. The print quality is improved as the number of pins increases. However, the print speed is lowered with an increase in the number of dots constituting one character. Further, the printer having such a print head consumes an excess amount of power, is large in size and expensive to manufacture. On the other hand, a high-speed printing is also performed by a 18-pin print head consisting of two columns of 9 pins. This 18-pin print head is operative at a print speed twice as large as the printing speed of the 9-pin print head 18*b* stated above, relative to the print quality of the 9-pin print head 18*b*.

It is therefore preferable to selectively use a high print-quality print head on an occasion when a high quality printing of characters such as Chinese characters is desired even at the sacrifice of low printing speed, and a high-speed print head when a high speed printing of characters such as alphabetical letters and numerals is desired even at the sacrifice of low print quality.

It is also possible to replace the print head in view of the type of print form or paper. For instance, a multi-layered form requires printing at a great impact force and hence a low-speed print head is suitable for such a form. Conversely, a high-speed, low noise print head is suitable for the printing of a single-layer form which requires only an average impact force.

The printer of the invention is also applicable to the printing of characters of various sizes as it accepts loading of various print heads having different pin spacings or pitches. Furthermore, the printer also accepts loading of both a print head with upright pins and a print head with diagonal or slanted pins so that italic characters and upright characters can be printed either singly or in combination.

In addition to the impact print heads stated above, a non-impact print head, such as a thermal head, can be loaded on the printer of the invention when a low noise printing is desired. The impact print heads are particularly suitable in an application where a high speed operation and/or a printing of multi-layered forms is a major requirement. As described above, the printer of the present invention enables loading of various types of print heads each having a respective application. The number of the acceptable print heads is not limited to two and a greater number of print heads are possible when an identification means is used as described later on. The types of the print heads are determined by the specification of the printer. It is, however, necessary to preset the correlation between the types of acceptable print heads and the identification signals so that the control portion and the head connectors can accommodate each other to such correlation.

In the first embodiment described above, the types of identifiable print heads are limited to two as the identification signal 213 has one bit information. However, the number of identifiable types of print heads is increased to $2^N$ when the corresponding number N of parallel identification signal lines are provided.

Figure 5A:
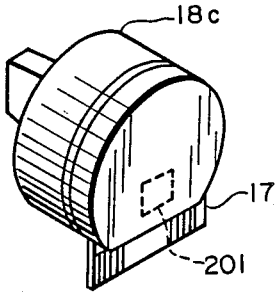
FIG. 5(*a*) is a perspective view of a print head according to a second embodiment.
Figure 5B:
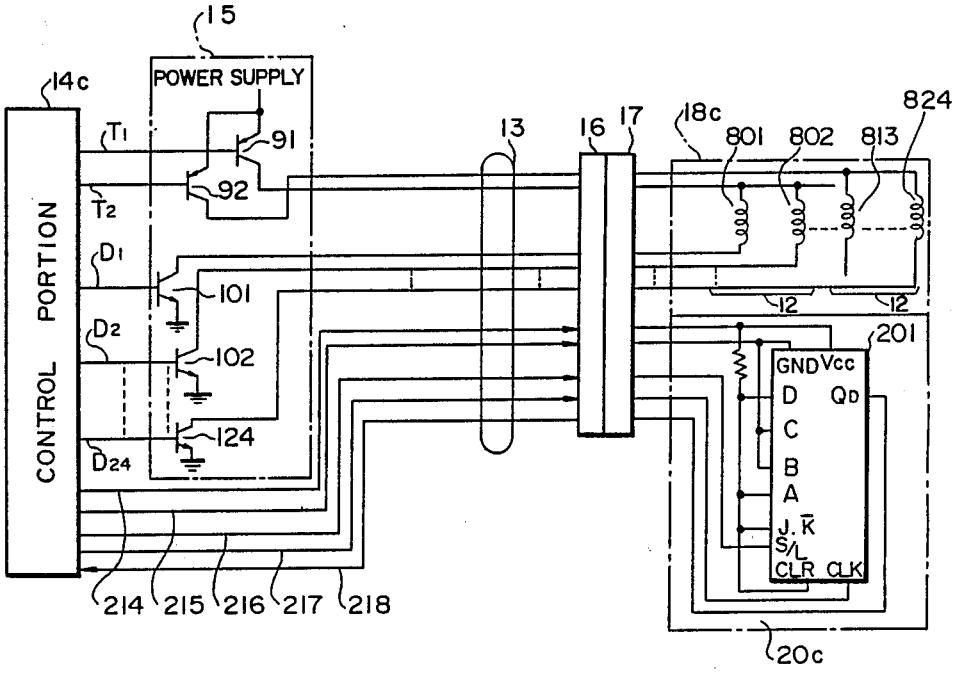

FIGS. 5(*a*) and 5(*b*) show a second embodiment of the invention which differs from the first embodiment in its print head identification system.

As shown in FIG. 5(*a*), a print head 18*c* includes an identification means 20*c* composed of a parallel-serial (P/S) converter 201 (corresponding to a device available under the code number 74LS195A) for producing a predetermined identification signal. As shown in FIG. 5(*b*), the printer of this embodiment includes five signal lines 214–218. The control portion 14*c* supplies a power (H) and the ground (L) respectively to a Vcc terminal and a GND terminal of the P/S converter 201 through the signal lines 214, 215. The control portion 14*c* also supplies a shift/load signal and a clock signal to a S/L terminal and a CLK terminal of the P/S converter 201 through the signal lines 216 and 217, respectively. The control portion 14*c* receives a serial identification signal from an output ($Q_D$) terminal of the P/S converter 201. To the input terminals A, D, J and K, and the clear (CLR) terminal, a high level signal (H) is given from the Vcc terminal. Likewise, the input terminals B and C of the P/S converter 201 receive a low level signal (L). With this arrangement, the P/S converter 201 has a preset input "1001" and hence issues a serial identification signal consisting of four bits information "1001" from the $Q_D$ terminal through the signal line 218 to the control portion 14*c*. The control portion 14*c* converts the serial identification signal into parallel data through a internal serial-parallel converter, thus identifying the type of the loaded print head 18*c* . According to the second embodiment, $2^4$ types of print heads can be identified.

Obviously, many modifications and variations of the present invention are possible in the light of the above teachings. It is therefore to be understood that within the scope of the appended claims, the invention may be practiced otherwise than as specifically described.

What is claimed is:

1. A printer comprising:

a print head having a print head connector;

a carriage having disposed thereon a carriage connector means for detachable connecting said print head via said print head connector;

a driver means for driving said print head;

a microprocessor means for controlling said driver means in accordance with an N-bit print head identification signal, wherein N is a positive integer;

a plurality of signal lines for connecting said microprocessor means to said carriage connector means; and, a parallel-to-serial converter means, disposed on said print head, for converting N parallel inputs into said N-bit print head identification signal, and for outputting said N-bit print head identification signal when said print head connector is connected to said carriage connector means, wherein said N-bit print head identification signal is transmitted to said microprocessor means via at least one of said plurality of signal lines;

wherein said N-bit print head identification signal is indicative of a type of said print head.

2. A printer as recited in claim 1, wherein said microprocessor means includes a means for applying a constant voltage to at least one of said plurality of signal lines and a ground to at least one other of said plurality of signal lines, and wherein said parallel-to-serial converter means includes wiring such that said constant voltage and said ground are applied to said N parallel inputs in a predetermined manner to thus obtain said N-bit print head identification signal when said print head connector is connected to said carriage connector means.

3. A printer as recited in claim 1, wherein said microprocessor means includes a means for applying a clock signal to at least one of said signal lines, and wherein said clock signal is applied to said parallel-to-serial converter when said print head connector is connected to said carriage connector means.

4. A printer as recited in claim 2, wherein said microprocessor means includes a means for applying a clock signal to at least one of said signal lines, and wherein said clock signal is applied to said parallel-to-serial converter when said print head connector is connected to said carriage connector means.

* * * * *